US012114721B2

(12) United States Patent
Hayes

(10) Patent No.: US 12,114,721 B2
(45) Date of Patent: Oct. 15, 2024

(54) HEAT PROTECTION GARMENT AND METHODS OF USE THEREOF

(71) Applicant: Kimberley Hayes, Brooklyn, NY (US)

(72) Inventor: Kimberley Hayes, Brooklyn, NY (US)

( * ) Notice: Subject to any disclaimer, the term of this patent is extended or adjusted under 35 U.S.C. 154(b) by 226 days.

(21) Appl. No.: 17/824,705

(22) Filed: May 25, 2022

(65) Prior Publication Data

US 2022/0378137 A1 Dec. 1, 2022

Related U.S. Application Data

(60) Provisional application No. 63/192,633, filed on May 25, 2021.

(51) Int. Cl.

| | |
|---|---|
| ***A42B 1/00*** | (2021.01) |
| ***A42B 1/008*** | (2021.01) |
| ***A42B 1/0187*** | (2021.01) |
| ***A42B 1/049*** | (2021.01) |
| *A42B 1/0188* | (2021.01) |
| *A45D 6/18* | (2006.01) |
| *A45D 20/18* | (2006.01) |

(52) U.S. Cl.

CPC ..... *A42B 1/008* (2013.01); *A42B 1/0187* (2021.01); *A42B 1/049* (2021.01); *A42B 1/0188* (2021.01); *A45D 6/18* (2013.01); *A45D 6/185* (2013.01); *A45D 20/18* (2013.01)

(58) Field of Classification Search

CPC ..... A42B 1/008; A42B 1/0187; A42B 1/049; A42B 1/0188; A45D 6/18; A45D 6/185; A45D 20/18

See application file for complete search history.

(56) References Cited

U.S. PATENT DOCUMENTS

| | | | | | |
|---|---|---|---|---|---|
| 1,274,842 | A * | 8/1918 | Basch | A41D 13/081 | D29/112 |
| 1,352,968 | A * | 9/1920 | Josephs | A42B 1/0188 | 2/172 |
| 1,845,689 | A * | 2/1932 | Turrell | A45D 44/12 | 2/209 |
| 2,118,273 | A * | 5/1938 | Smith | A45D 44/12 | 2/174 |
| 2,159,435 | A * | 5/1939 | Gribbin | A45D 44/12 | 2/209 |
| 2,296,078 | A * | 9/1942 | Young | A45D 44/12 | 2/174 |

(Continued)

FOREIGN PATENT DOCUMENTS

| | | | | |
|---|---|---|---|---|
| WO | WO-0178552 A1 * | 10/2001 | ..... | A45D 44/12 |

*Primary Examiner* — Khaled Annis

(74) *Attorney, Agent, or Firm* — ArentFox Schiff LLP

(57) ABSTRACT

A heat protection garment configured to protect the skin of a wearer may include an ear cover and a forehead cover. The ear cover may include a first surface and a second surface. The first surface may be configured to overlie the skin of the wearer. The second surface may be opposite the first surface. The second surface may include one or more first attachment features. The forehead cover may include a first surface configured to overlie the skin of the wearer and a second surface opposite the first surface. The forehead cover may include one or more second attachment features configured to releasably engage the one or more first attachment features.

17 Claims, 9 Drawing Sheets

(56) References Cited

U.S. PATENT DOCUMENTS 4,223,407 A * 9/1980 Zappala ..... A45D 44/12 2/174
5,023,954 A * 6/1991 Lyons ..... A61F 11/06 2/209
5,395,400 A * 3/1995 Stafford ..... A42B 1/008 2/209
5,423,091 A * 6/1995 Lange ..... A61F 13/122 2/DIG. 11
5,718,001 A * 2/1998 Wright ..... A45D 44/12 2/209
5,835,609 A * 11/1998 LeGette ..... A61F 11/14 2/209
6,237,157 B1 * 5/2001 Lobbins ..... A45D 44/12 2/209
6,298,493 B1 * 10/2001 Ambroise ..... A45D 44/12 2/209
6,505,633 B2 * 1/2003 Mosely ..... A45D 44/12 132/319
7,024,013 B1 * 4/2006 Van Dam ..... A61F 11/14 2/209
7,614,091 B2 * 11/2009 LeGette ..... A61F 11/14 128/857
7,865,974 B1 * 1/2011 Heller ..... A61F 11/06 2/209
D777,989 S * 1/2017 Gerspach ..... D29/112
10,555,574 B2 * 2/2020 Woo ..... A42B 1/0182
11,076,650 B2 * 8/2021 Tussey ..... A42B 1/22
11,076,684 B2 * 8/2021 Mirzaians ..... A45D 44/12
2002/0023285 A1 * 2/2002 Mosely ..... A45D 44/12 132/212
2005/0034217 A1 * 2/2005 Healy ..... A61F 11/14 2/209
2008/0052804 A1 * 3/2008 Woodward ..... A42B 1/0188 2/209
2008/0307562 A1 * 12/2008 Tipp ..... A61F 11/14 2/209
2009/0013447 A1 * 1/2009 Drosihn ..... A42B 1/0188 2/209
2016/0198830 A1 * 7/2016 Tussey ..... A42B 1/049 2/183
2016/0374419 A1 * 12/2016 Hunley ..... A42B 1/008 2/171.2
2019/0037944 A1 * 2/2019 Tussey ..... A42B 1/049
2020/0077768 A1 * 3/2020 Mirzaians ..... A45D 44/12
2020/0337403 A1 * 10/2020 Castillo ..... A42B 1/008
2022/0378137 A1 * 12/2022 Hayes ..... A42B 1/0188

* cited by examiner

HEAT PROTECTION GARMENT AND METHODS OF USE THEREOF

CROSS-REFERENCE TO RELATED APPLICATIONS

This application claims the benefit of U.S. Provisional Patent Application No. 63/192,633, filed May 25, 2021 and hereby incorporates by reference herein the contents of this application.

FIELD

This disclosure relates generally to a heat protection garment for use with hair styling techniques that involve the use of heat and/or chemicals.

BACKGROUND

Many types of hairstyling techniques rely on heated hairstyling devices, such as sit-under hair dryers (e.g., hooded hair dryers, bonnet hair dryers, dryer chairs, and so forth), hot combs, flat irons, electric curlers, curling irons or wands, blow dryers, and other heated hairstyling devices. Such heated hairstyling devices may be used in hairstyling techniques that involve the application of high temperatures to hair as the hair is being styled. However, styling techniques involving such heated hairstyling can result in inadvertent burns to the skin near the hair being styled, such as the ears, forehead, and neck.

Current devices for heat protection from heated hairstyling devices include plastic ear caps. However, these plastic ear caps are typically not made of a heat-resistant material, and typically reach high temperatures seconds of exposure to heated hairstyling devices. Alternatively, a towel may be wrapped around the back of the ears of the person whose hair is being styled, and the towel may hang behind the neck to protect the neck from the heat. However, towels large enough to cover the ears and back of the neck are typically bulky and can interfere with the hairstyling techniques.

SUMMARY

The following aspects and aspects thereof are described and illustrated in conjunction with systems, tools and methods which are meant to be examples and illustrative, not limiting in scope.

In one aspect, a heat protection garment configured to protect the skin of a wearer may include an ear cover. The ear cover may include a first lobe, a second lobe, and a connecting portion between the first lobe and the second lobe. The ear cover may include a first surface configured to overlie the skin of the wearer, a second surface opposite the first surface, and a panel coupled to the first surface of one of the first and second lobe to form a pocket between the panel and the first surface.

In one aspect, a heat protection garment configured to protect the skin of a wearer may include an ear cover and a forehead cover. The ear cover may include a first surface and a second surface. The first surface may be configured to overlie the skin of the wearer. The second surface may be opposite the first surface. The second surface may include one or more first attachment features. The forehead cover may include a first surface configured to overlie the skin of the wearer and a second surface opposite the first surface. The forehead cover may include one or more second attachment features configured to releasably engage the one or more first attachment features.

In one aspect, a heat protection garment configured to protect skin of a wearer may include an ear cover and a neck cover. The ear cover may include a first surface configured to overlie the skin of the wearer and a second surface opposite the first surface. The second surface may include one or more first attachment features. The neck cover may a first surface configured to overlie the skin of the wearer and a second surface opposite the first surface. The neck cover may include one or more second attachment features configured to releasably engage the one or more first attachment features.

In addition to the example aspects and aspects described above, further aspects and aspects will become apparent by reference to the drawings and by study of the following detailed description.

BRIEF DESCRIPTION OF THE DRAWINGS

Example aspects are illustrated in the drawings. It is intended that the aspects and figures disclosed herein are to be considered illustrative rather than restrictive.

DETAILED DESCRIPTION

Figure 1:
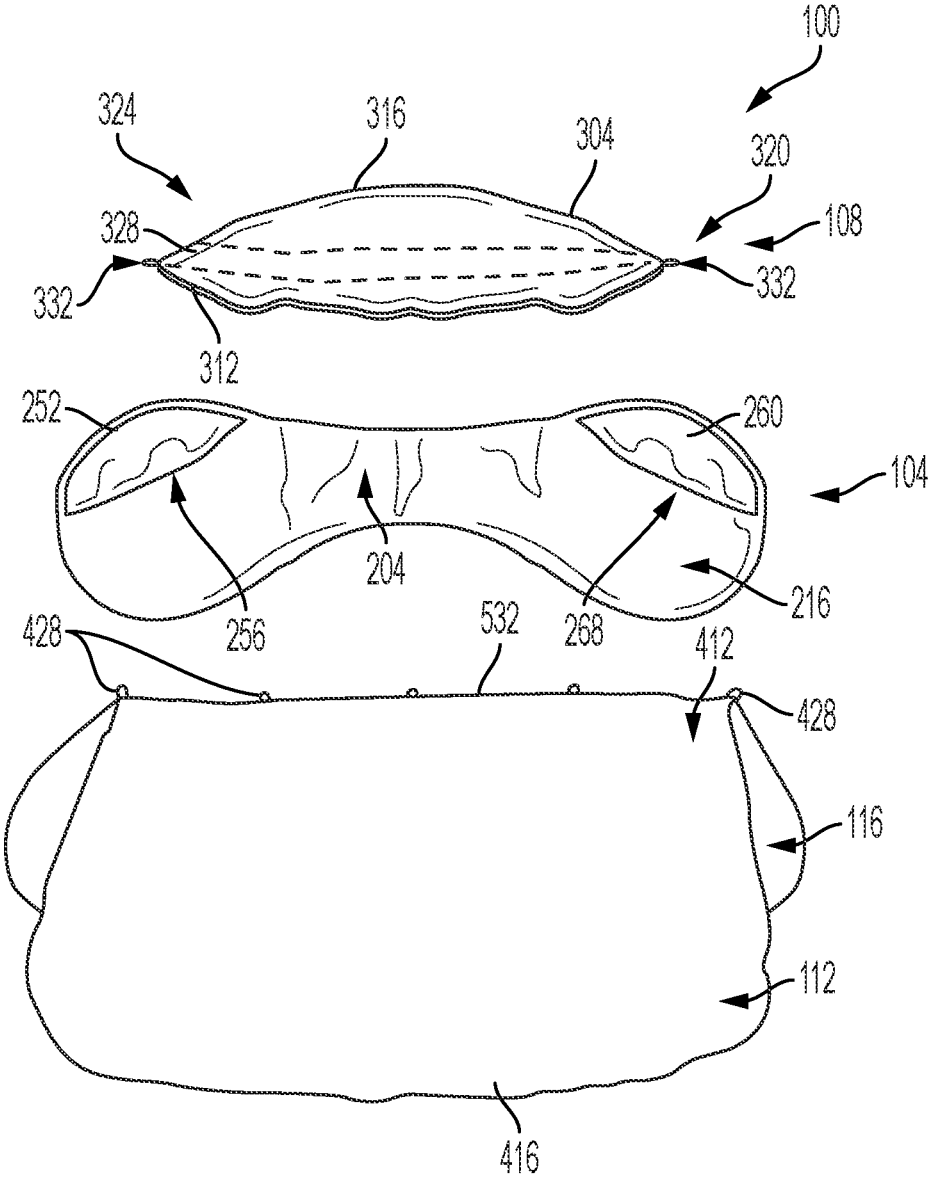
FIG. 1 illustrates an example heat protection garment in accordance with an aspect of the disclosure.

In the following detailed description, reference is made to the accompanying figures, which form a part thereof. In the figures, similar symbols typically identify similar components, unless context dictates otherwise. The illustrative aspects described in the detailed description, figures, and claims are not meant to be limiting. Other aspects may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The following includes definitions of selected terms employed herein. The definitions include various examples and/or forms of components that fall within the scope of a term and that may be used for implementation. The examples are not intended to be limiting. Further, it will be clear to one skilled in the art that the present disclosure may be practiced without these specific details. In other instances, well-known methods, procedures, and components have not been described in detail so as to not unnecessarily obscure aspects of the present disclosure.

Throughout the disclosure, the term substantially or approximately may be used as a modifier for a geometric relationship between elements or for the shape of an element or component. While the terms substantially or approximately are not limited to a specific variation and may cover any variation that is understood by one of ordinary skill in the art to be an acceptable variation, some examples are provided as follows. In one example, the terms substantially or approximately may include a variation of less than 10% of the dimension of the object or component. In another example, the terms substantially or approximately may include a variation of less than 5% of the object or component. If the terms substantially or approximately are used to define the angular relationship of one element to another element, one non-limiting example of the terms may include a variation of 5 degrees or less. These examples are not intended to be limiting and may be increased or decreased based on the understanding of acceptable limits to one of ordinary skill in the art.

Throughout the disclosure, references are made to heated hairstyling devices. As used herein, the phrase "heating hairstyling device" is used to refer to hairstyling devices that apply high temperatures to hair to style the hair. Examples of such heated hairstyling devices may include sit-under hair dryers (e.g., hooded hair dryers, bonnet hair dryers, dryer chairs, and so forth), hot combs, flat irons, electric curlers, curling irons or wands, blow dryers, and other heated hairstyling devices.

FIGS. 1-5 illustrate an example heat protection garment 100 configured to protect a wearer's forehead, ears, and skin during hairstyling techniques that involve the use of heated hairstyling devices that apply high temperatures to the hair of the wearer as the hair of the wearer is being styled. The heat protection garment 100 may include an ear cover 104, a forehead cover 108, a first neck cover 112, and a second neck cover 116.

Figure 2:
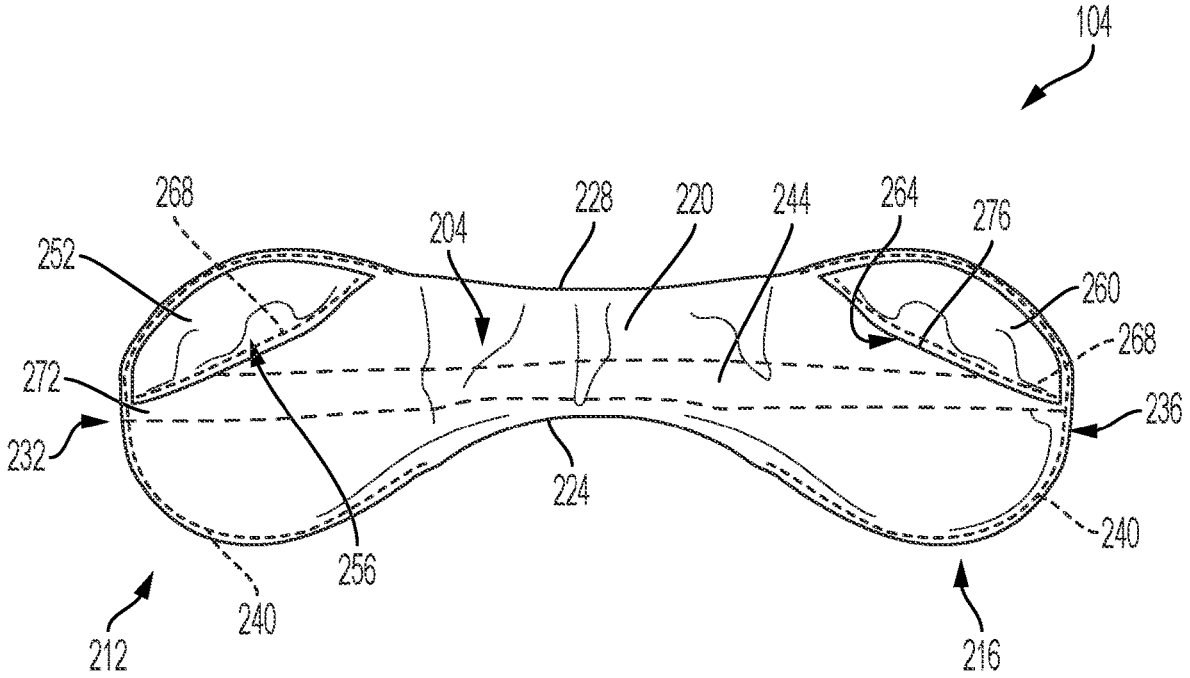
FIG. 2 illustrates a front view of an ear cover of the example heat protection garment of FIG. 1 in accordance with an aspect of the disclosure.
Figure 3:
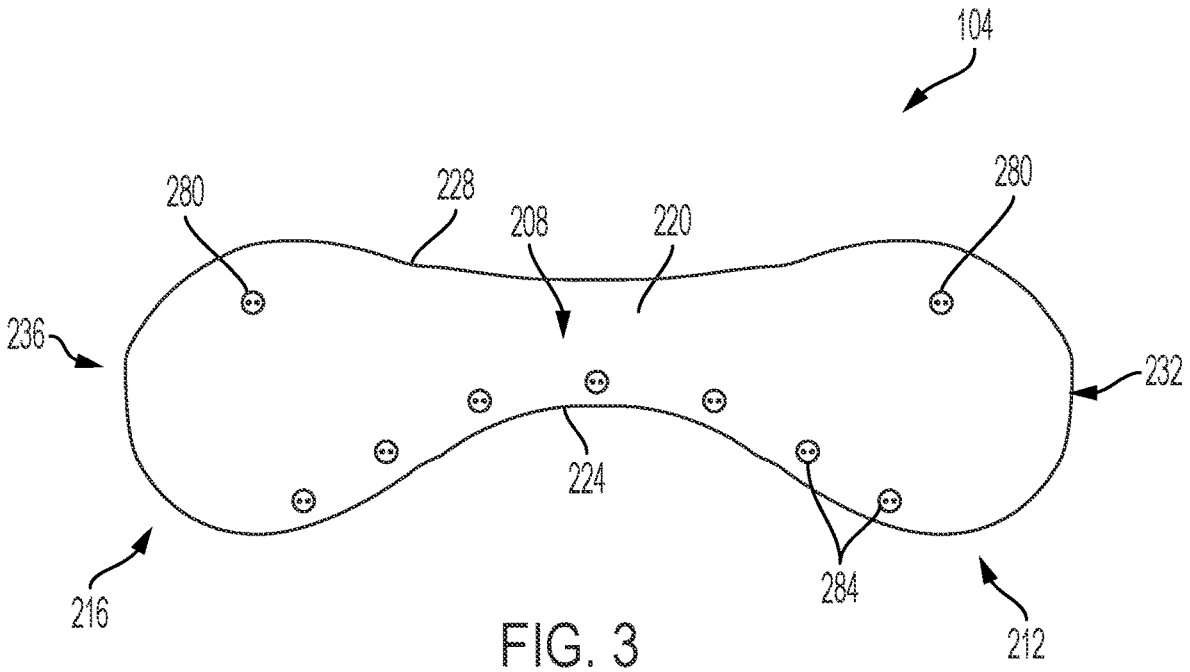
FIG. 3 illustrates a rear view of the ear cover of FIG. 2 in accordance with an aspect of the disclosure.

As shown in FIGS. 2-3, the ear cover 104 may include a first surface 204 (FIG. 2) configured to lie adjacent the user's skin, and a second surface 208 (FIG. 3) opposite the first surface 204. The first and second surfaces 204, 208 may be or include a cotton material, a terrycloth material, or another type of material that can provide heat protection while also being comfortable against the skin of the wearer. In some aspects, the ear cover 104 may include a filling such as cotton fiber between the first and second surfaces 204, 208 to provide further heat protection.

The ear cover 104 may include a first lobe 212, a second lobe 216, and a connecting portion 220 between the first lobe 212 and the second lobe 216. The connecting portion 220 may be configured to overlie a portion of the neck of the wearer. The first lobe 212 and the second lobe 216 may be configured to overlie first and second ears, respectively, of the wearer and prevent burns to the ears and/or neck of the wearer from heated hairstyling devices.

The ear cover 104 may include opposing first and second edges 224, 228 and opposing first and second sides 232, 236. In some aspects, a curvature of the first edge 224 of the ear cover 104 may be larger than a curvature of the second edge 228 of the ear cover 104. In some aspects, the ear cover 104 may include wiring 240 along at least a portion of the first and second lobes 212, 216. In some aspects, this wiring 240 may be positioned along a perimeter of one or more of the first and second lobes 212, 216 (e.g., along one or more of the portions of the edges 224, 228 and/or sides 232, 236 that form the first and second lobes 212, 216). In some in some aspects, the wiring 240 may extend along a perimeter of the ear cover 104. The wiring 240 may be positioned between the first and second surfaces 204, 208 of the ear cover 104. The wiring 240 may be bent or reshaped by the wearer (or another user) to allow the ear cover 104 to more closely conform to a shape of the ears and/or neck of the wearer. In some aspects, the connecting portion 220 may include an elastic element 244 coupled between the first and second sides 232, 236. The elastic element 244 may be configured to position the ear cover 104 snugly about the neck of the user. The wiring 240 and/or the elastic element 244 may allow the ear cover 104 to fit wearers with different shapes and/or sizes of heads, different ear positions and/or sizes, and so forth.

As shown in FIG. 2, the first lobe 212 may include may include a first panel 252 coupled to the first surface 204 along the second edge 228 and the first side 232, forming a first pocket 256 therebetween. The second lobe 216 may include a second panel 260 coupled to the first surface 204 along the second edge 228 and the second side 236, forming a second pocket 264 therebetween. The first and second pockets 256, 264 may each be configured to receive an ear of the wearer therein and protect the tops of the ears from burns from heated hairstyling devices. In some aspects, each of the panels 252, 260 may include elastic 268 along at least one edge to secure the ears of the wearer in the pockets 256, 264, respectively. For example, the elastic 268 may be positioned along ends 272, 276 respectively, of the panels 252, 260 proximate openings of the pockets 256, 264. In some aspects, the elastic 268 may be positioned along a perimeter of the pockets 256, 264.

FIG. 3 illustrates the second surface 208 of the ear cover 104. The first lobe 212 and the second lobe 216 of the ear cover 104 may each include an attachment feature 280 on the second surface 208. In some aspects, the attachment features 280 may be proximate the second edge 228 of the ear cover 104. As described in greater detail below, the attachment features 280 may be configured to engage corresponding attachment features of the forehead cover 108 to releasably couple the ear cover 104 and the forehead cover 108. In some aspects, the attachment features 280 may include buttons. In other aspects, the attachment features 280 may include buttonholes, elastic loops, fabric loops, Velcro strips, hook-and-eye features, snaps, magnets, adhesives, and so forth. The second surface 208 of the ear cover 104 may further include a plurality of attachment features 284 along the first edge 224 of the ear cover 104. The attachment features 284 may be configured to engage corresponding attachment features of the first and/or second neck covers 112, 116, as described in greater detail below. The attachment features 284 may be substantially similar to the attachment features 280 and are not discussed in further detail herein.

As shown in FIG. 1, the forehead cover 108 may have a generally elongate shape and may be configured to overlie a portion of the forehead of the wearer at or proximate a hairline of the wearer. The forehead cover 108 may be configured to protect the forehead of the wearer from heated hairstyling devices used to style hair near the hairline and/or forehead of the wearer. The forehead cover 108 may include a first surface 304 configured to lie adjacent the skin of the wearer, and a second surface 308 (FIG. 5) opposite the first surface 304. The first and second surfaces 304, 308 may be or include a cotton material, a terrycloth material, or another type of material that can provide heat protection while also being comfortable against the skin of the wearer. In some aspects, the forehead cover 108 may include a filling such as cotton fiber between the first and second surfaces 304, 308 to provide further heat protection.

The forehead cover 108 may include opposing first and second edges 312, 316 and opposing first and second sides 320, 324. In some aspects, the first edge 312 may be substantially linear. When the forehead cover 108 is engaged with the wearer, the first edge 312 may lay proximate a hairline of the wearer. In some aspects, the second edge 316 may be substantially arcuate. In some aspects, the forehead cover 108 may include an elastic element 328 coupled between the first and second sides 320, 324. The elastic element 328 may be configured to position the forehead cover 108 snugly about the forehead of the user. The elastic element 328 may allow the forehead cover 108 to fit wearers with different shapes and/or sizes of heads.

The forehead cover 108 may include attachment features 332 at the first and second sides 320, 324. In some aspects, the attachment features 332 may be positioned at or proximate the first edge 312. The attachment features 332 may be configured to engage the attachment features 280 on the ear cover 104 to releasably couple the ear cover 104 and the forehead cover 108. In some aspects, the attachment features 332 may include elastic loops. In other aspects, the attachment features 280 may include buttons, button holes, elastic loops, fabric loops, Velcro strips, hook-and-eye features, snaps, magnets, adhesives, and so forth.

Figure 4:
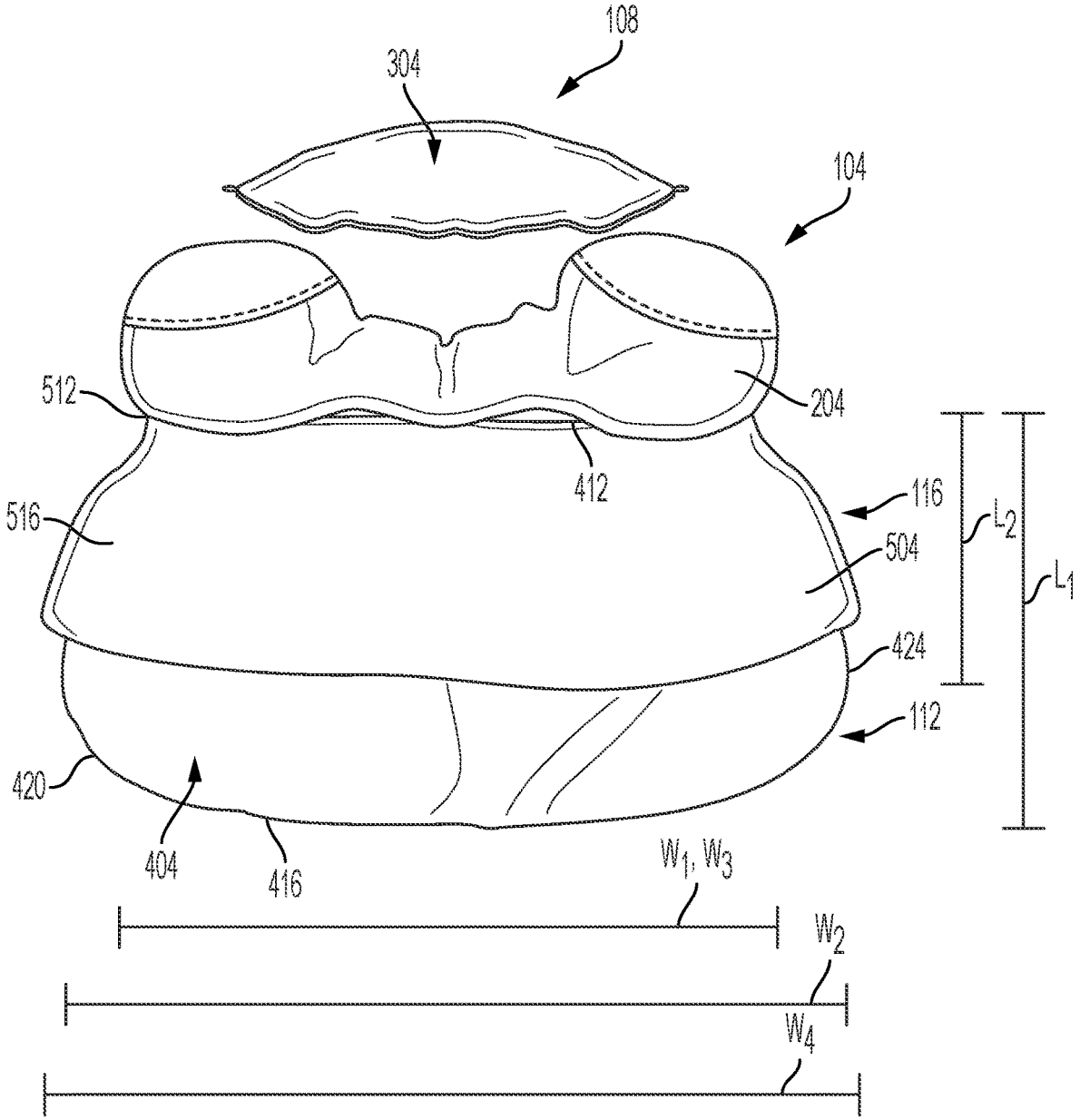
FIG. 4 illustrates a front view of the example heat protection garment of FIG. 1 in accordance with an aspect of the disclosure.

As shown in FIGS. 1 and 4, the first neck cover 112 may have a generally elongate shape and may be configured to overlie a portion of the neck and/or shoulders of the wearer. The first neck cover 112 may include a first surface 404 configured to lie adjacent the skin of the wearer, and a second surface 408 (FIG. 5) opposite the first surface 404. The first and second surfaces 404, 408 may be or include a cotton material, a terrycloth material, or another type of material that can provide heat protection while also being comfortable against the skin of the wearer.

The first neck cover 112 may include opposing first and second edges 412, 416 and opposing first and second sides 420, 424. In some aspects, the first edge 412 may be substantially linear. In some aspects, the second edge 416 may be substantially arcuate or have curved ends. In some aspects, the first edge 412 may have a width W1 that is longer than a width W2 of the second edge 416. In such aspects, the sides 420, 424 may be oriented at obtuse angles with respect to the first edge 412. In aspects that do not include the second neck cover 116, the first neck cover 112 may include a plurality of attachment features 428 (FIG. 1) along or proximate the first edge 412. The attachment features 428 may be configured to engage the attachment features 284 on the ear cover 104 to releasably couple the ear cover 104 and the first neck cover 112 to protect the back and sides of the neck of the wearer from heated hairstyling devices. The attachment features 428 may be substantially similar to the attachment features 332 and are not discussed in detail herein for the sake of brevity.

Figure 5:
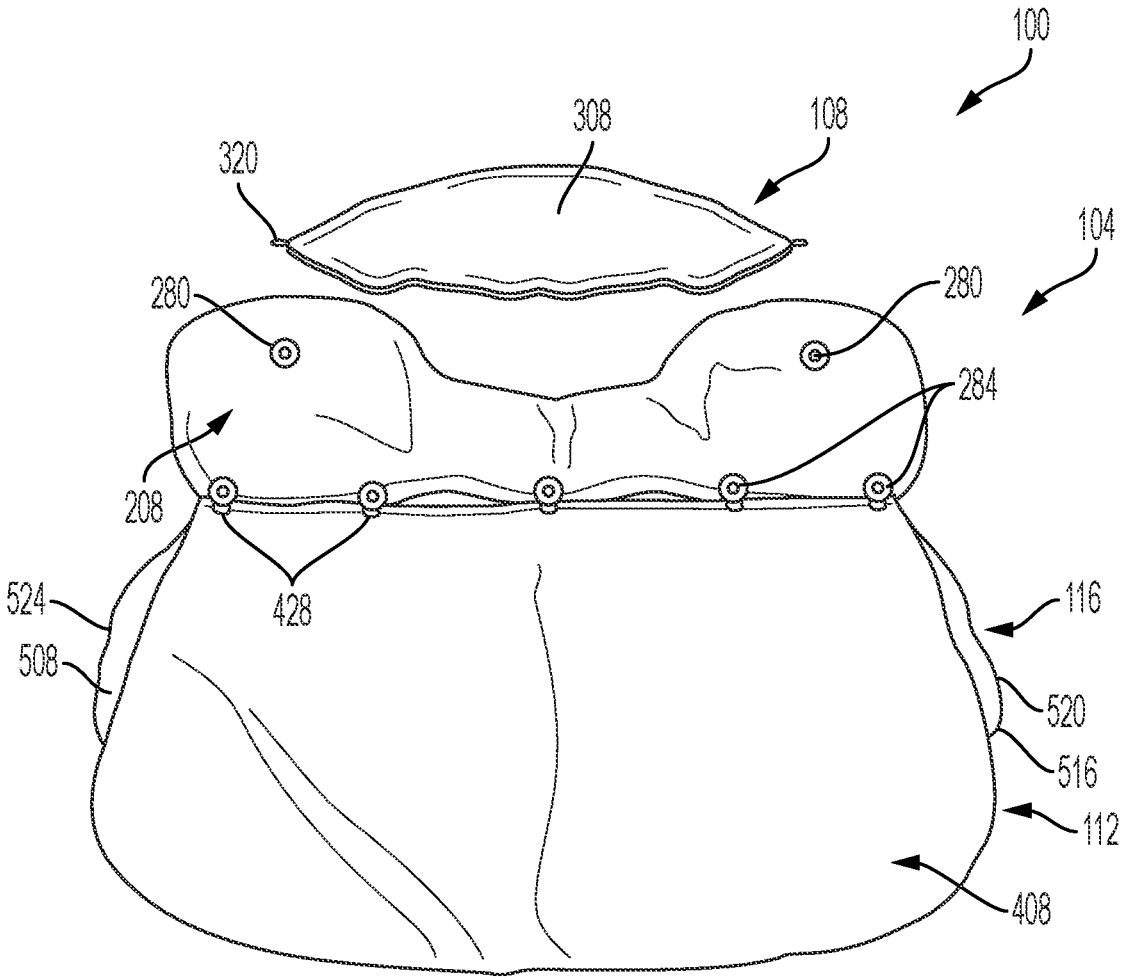
FIG. 5 illustrates a rear view of the example heat protection garment of FIG. 1 in accordance with an aspect of the disclosure.

As shown in FIG. 5, the second neck cover 116 may include a first surface 504 configured to lie adjacent the skin of the wearer, and a second surface 508 (FIG. 4) opposite the first surface 504. The first and second surfaces 504, 508 may be or include a cotton material, a terrycloth material, or another type of material that can provide heat protection while also being comfortable against the skin of the wearer.

The second neck cover 116 may include opposing first and second edges 512, 516 and opposing first and second sides 520, 524. In some aspects, the first edge 512 may be substantially linear. In some aspects, the second edge 516 may be substantially arcuate or have curved ends. In some aspects, the first edge 512 may have a width W3 (FIG. 4) that is longer than a width W4 (FIG. 4) of the second edge 516. In such aspects, the sides 520, 524 may be oriented at obtuse angles with respect to the first edge 512. In aspects that do not include the first neck cover 112, the second neck cover 116 may include a plurality of attachment features 428 along or proximate the first edge 512. The attachment features 428 may be configured to engage the attachment features 572 on the ear cover 104 to releasably couple the ear cover 104 and the second neck cover 116 to protect the back and sides of the neck from high temperature hairstyling devices. The attachment features 428 may be substantially similar to the attachment features 332 and are not discussed in detail herein for the sake of brevity.

As shown in FIGS. 1 and 4-5, in aspects that include both the first neck cover 112 and the second neck cover 116, the first edge 412 of the first neck cover 112 may be sewn to the first edge 512 of the second neck cover 116, for example at seam 532. In such aspects, the attachment features 428 may be at or proximate the seam 532. In such variants, the widths W1 of the first neck cover 112 and W3 of the second neck cover 116 may be substantially similar.

In aspects that include both the first neck cover 112 and the second neck cover 116, the sides 420, 424 of the first neck cover 112 may have a length L1 that is greater than a length L2 of the sides 520, 524 of the second neck cover 116. In such aspects, the second neck cover 116 may be shorter than the first neck cover 116.

In aspects that include both the first neck cover 112 and the second neck cover 116, the width W4 of the second edge 516 of the second neck cover 116 may be greater than the width W2 of the second edge 416 of the first neck cover 112.

FIGS. 4 and 5 illustrate front and rear views of the heat protection garment 100 in which the forehead cover 108 and the first and second neck covers 112, 116 are coupled to the ear cover 104. In FIG. 4, the first surface 204 of the ear cover 104, the first surface 304 of the forehead cover 108, the first surface 404 of the first neck cover 112, and the first surface 504 of the second neck cover 116 are shown. The first surfaces 204, 304, 404, and 504 may contact and/or overlie the forehead, ears, and neck, respectively, of a wearer of the heat protection garment 100.

In FIG. 5, the second surface 208 of the ear cover 104, the second surface 308 of the forehead cover 108, the second surface 408 of the first neck cover 112, and the second surface 508 of the second neck cover 116 are shown. The second surfaces 208, 308, 408, and 508 may be exposed when the heat protection garment 100 is being worn. Heated hairstyling devices may contact the second surfaces 208, 308, 408, and 508 of the heat protection garment 100 when the hair of a wearer of the heat protection garment 100 is being styled. This may protect the skin of the wearer's forehead, ears, and neck from being contacted or burned by the heated hairstyling devices.

As shown in FIG. 5, the forehead cover 108 is coupled to the ear cover 104 by the attachment features 332 of the forehead cover 108 and the attachment features 480 of the ear cover. The neck covers 112, 116 are coupled to the ear cover 104 by the attachment features 428 of the neck covers 112, 116 and the attachment features 284 of the ear cover 104. As described above, in some aspects, the attachment features 280, 284, 332, 428 buttons, button-holes, elastic features such as loops, fabric loops, Velcro strips, hook-and-eye features, snaps, magnets, adhesives, and so forth. In variants in which at least one of the attachment features 280, 284, 332, 428 includes an elastic feature, the attachment feature 280, 284, 332, 428 may include a stretchable element configured to stretch when the heat protection garment 100 is worn by the user, allowing the heat protection garment 100 to be worn by users with different head sizes. In some aspects, the heat protection garment 100 may include multiple attachment features near the positions shown for the attachment features 280, 284, 332, 428 (e.g., attachment features arranged in rows or columns). This may allow variation in the dimensions of the heat protection garment 100, which may allow the heat protection garment 100 to be worn by users with different sized heads.

In some aspects, the wearer may wear the ear cover 104, the forehead cover 108, and the first and second neck covers 112, 116. In some aspects, the neck covers 112, 116 may be optional. In such aspects, the wearer may wear the ear cover 104 and the forehead cover 108. In some aspects, the forehead cover 104 may be optional. In such aspects, the wearer may wear the ear cover 104 and the first neck cover 112 and/or the second neck cover 116.

FIGS. 6-9 illustrate further aspects of another example heat protection garment 600 according to aspects of the present disclosure. Like parts between the heat protection garment 100 of FIGS. 1-5 and the heat protection garment 600 of FIGS. 6-9 are described using similar numbers. Similar corresponding aspects of the heat protection garment 600 to those already described for the heat protection garment 100 are omitted for brevity.

The heat protection garment 600 may include an ear cover 604, a forehead cover 608, a first neck cover 612, and a second neck cover 616. In some aspects, the first neck cover 612 and/or the second neck cover 616 may be optional. The forehead cover 608, the first neck cover 612, and the second neck cover 616 are substantially similar to the forehead cover 108, the first neck cover 112, and the second neck cover 116 of the heat protection garment 100 and are not described in detail herein. The ear cover 604 is similar to the ear cover 104 of the heat protection garment 100. The ear cover 604 is described in detail herein to the extent that differs from the ear cover 104.

Figure 6:
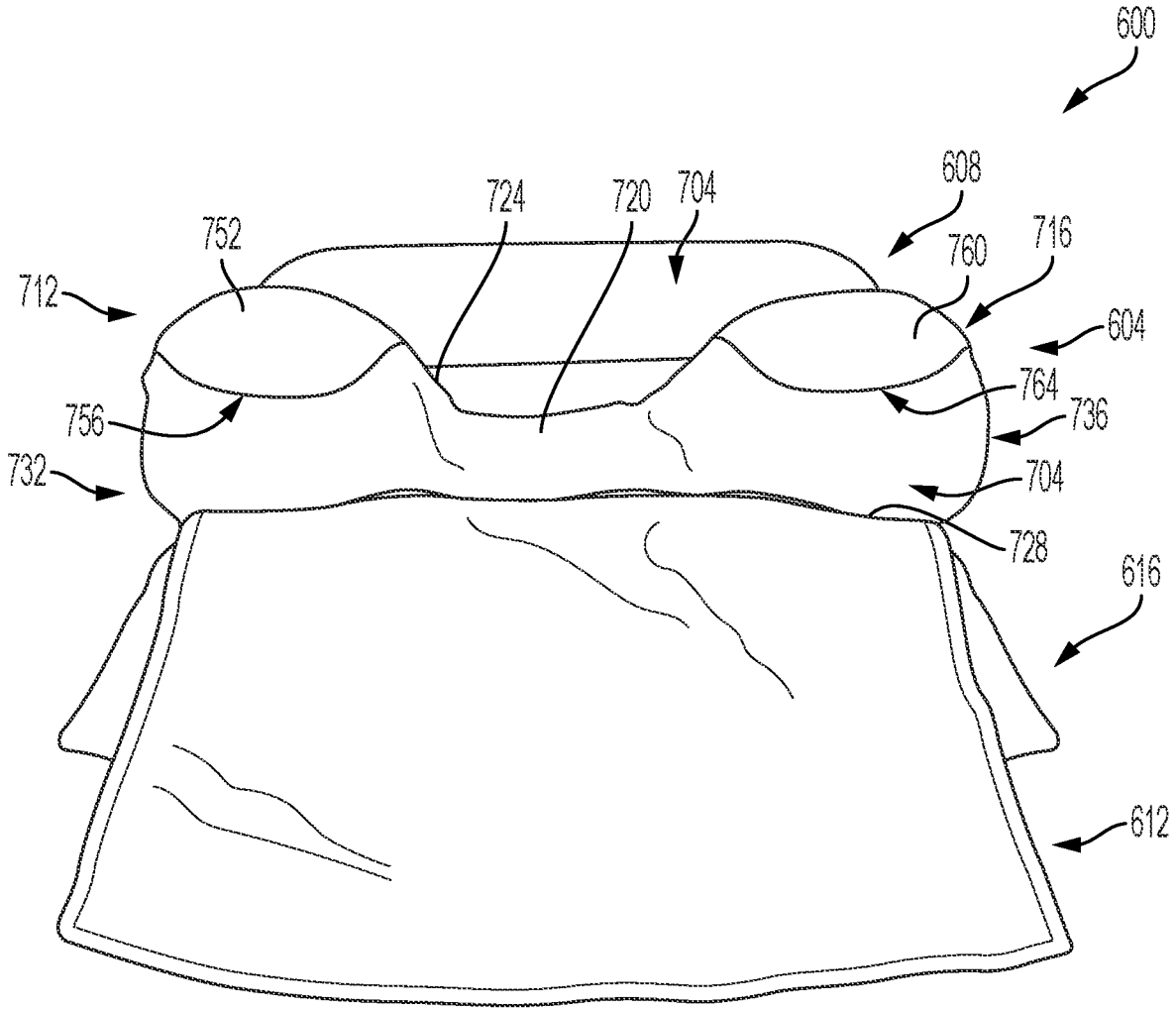
FIG. 6 illustrates a front view of the example heat protection garment in accordance with an another aspect of the disclosure.
Figure 7:
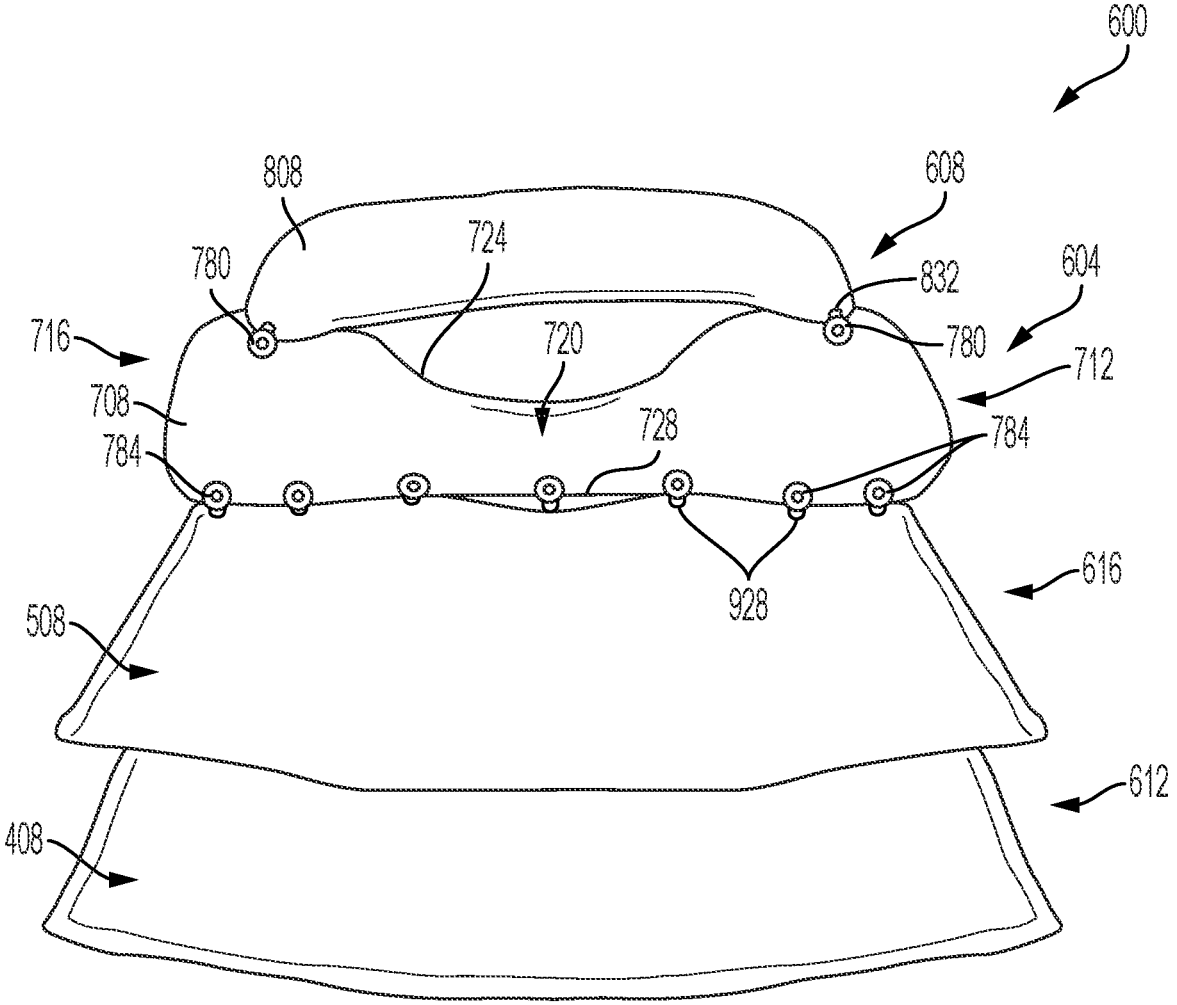
FIG. 7 illustrates a rear view of an example heat protection garment of FIG. 6 in accordance with an aspect of the disclosure.

FIG. 6 illustrates a front view of the heat protection garment 600. FIG. 7 illustrates a rear view of the heat protection garment 700. As shown in FIGS. 6-7, the ear cover 604 may include a first surface 704 (FIG. 6) configured to lie adjacent the user's skin, and a second surface 708 (FIG. 7) opposite the first surface 704. The ear cover 604 may include opposing first and second edges 724, 728 and opposing first and second sides 732, 736. In some aspects, a curvature of the first edge 724 of the ear cover 604 may be larger than a curvature of the second edge 728 of the ear cover 604.

As shown in FIG. 6, a first lobe 712 may include a first panel 752 coupled to the first surface 704 along the first edge 724 and a first side 732, forming a first pocket 756 therebetween. A second lobe 716 may include a second panel 760 coupled to the first surface 704 along the first edge 724 and the second side 736, forming a second pocket 764 therebetween. The first and second pockets 756, 764 may each be configured to receive an ear of the wearer therein (FIGS. 8-9) and protect the tops of the ears from burns from heated hairstyling devices.

As shown in FIG. 7, the first lobe 712 and the second lobe 716 of the ear cover 604 may each include an attachment feature 780 on the second surface 708. In some aspects, the attachment features 780 may be proximate the first edge 724 of the ear cover 604. As shown in FIG. 7, the attachment features 780 may be configured to engage corresponding attachment features 832 of the forehead cover 608 to releasably couple the ear cover 604 and the forehead cover 608. The attachment features 780 may be substantially similar to the attachment features 280 of the heat protection garment 100. The attachment features 832 may be substantially similar to the attachment features 332 of the heat protection garment 100. The second surface 708 of the ear cover 604 may further include a plurality of attachment features 784 along the second edge 728 of the ear cover 604. The attachment features 784 may be configured to engage corresponding attachment features 928 of the first and/or second neck covers 712, 716, as shown in FIG. 7. The attachment features 784 may be substantially similar to the attachment features 284 and are not discussed in further detail herein. The attachment features 928 may be substantially similar to the attachment features 428 of the heat protection garment 100.

Figure 8:
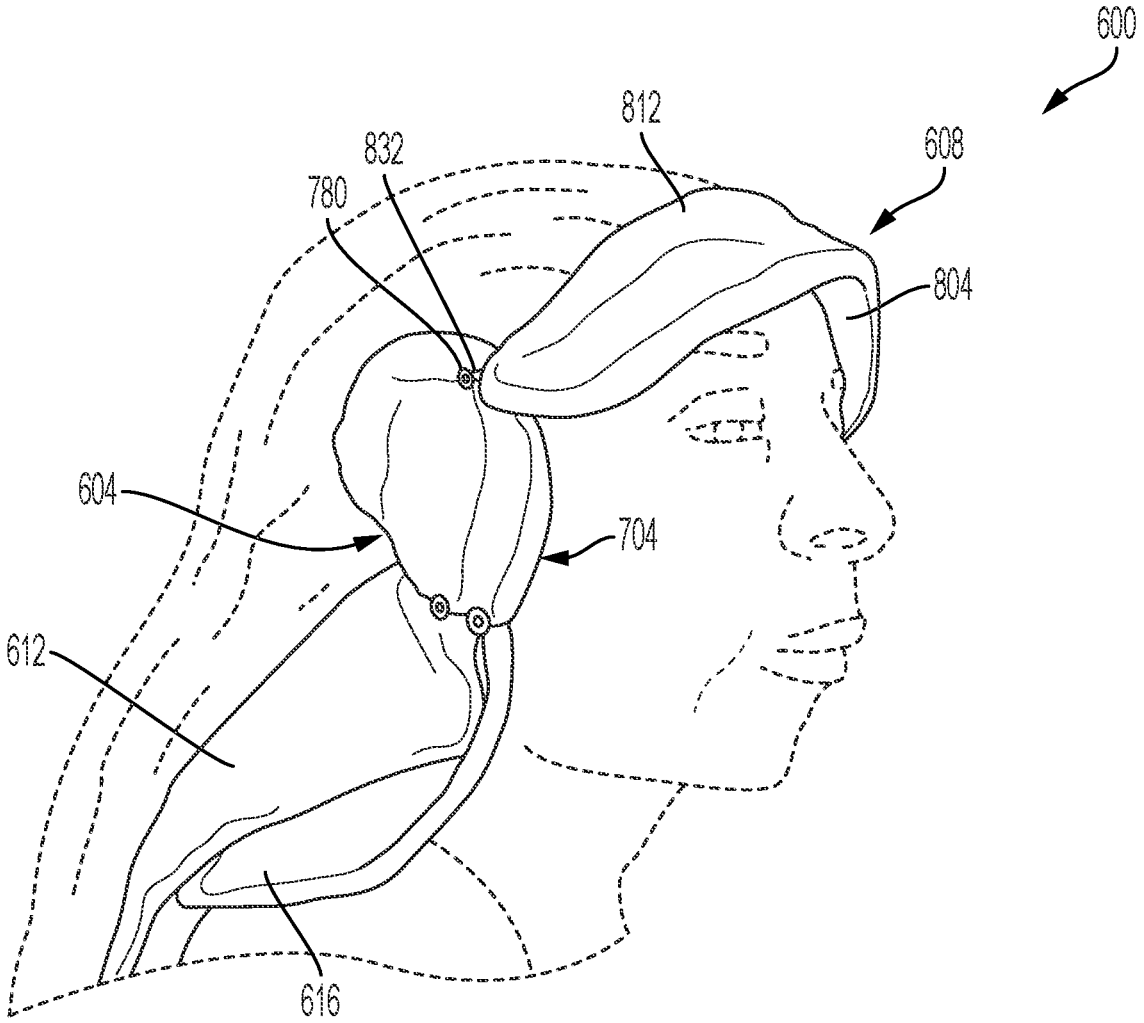
FIG. 8 illustrates a front perspective view of a person wearing the example heat protection garment of FIG. 6 in accordance with an aspect of the disclosure.
Figure 9:
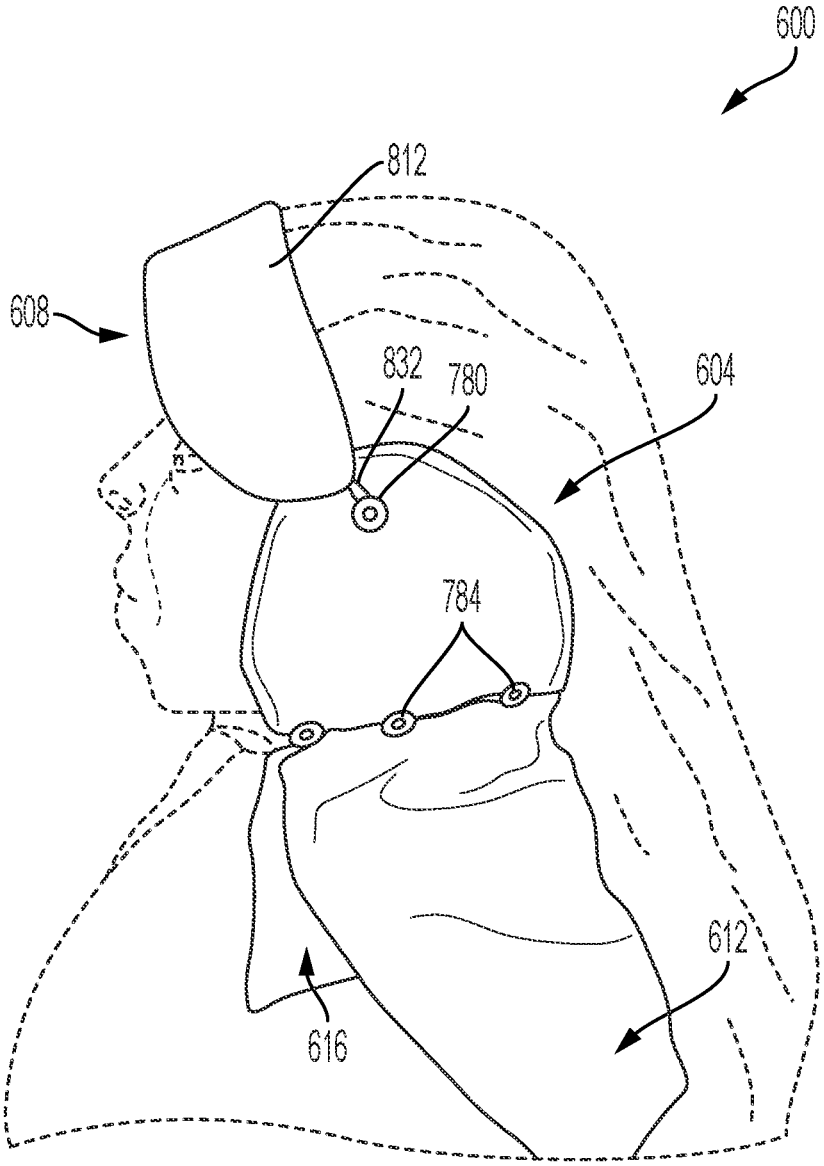
FIG. 9 illustrates a side view of a person wearing the example heat protection garment of FIG. 6 in accordance with an aspect of the disclosure.

FIG. 8 illustrates a front perspective view of the heat protection garment 600 engaged with a head of a wearer, according to some aspects of the present disclosure. FIG. 9 illustrates a side view of the heat protection garment 600 engaged with the head of the wearer, according to some aspects of the present disclosure.

As shown in FIGS. 8-9, the heat protection garment 600 overlies at least a portion of the exposed skin of the forehead, ears, and neck of the wearer. For example, the forehead cover 608 may cover the forehead of the wearer. The first edge 812 of the forehead cover may lie adjacent the hairline of the wearer, and the first surface 804 of the forehead cover 608 may overlie the forehead of the wearer. This may prevent heated hairstyling devices from contacting the skin of the wearer while hairstyling techniques using heated hairstyling devices are used to style the hair near the forehead of the wearer. The ear cover 604 may overlie the ears and at least a portion of the back of the neck of the wearer. The first surface 704 of the ear cover 604 may overlie the ears and at least a portion of the neck of the wearer. The ears of the wearer may be received within the ear pockets 756, 764. This may prevent heated hairstyling devices from contacting the skin of the wearer while hairstyling techniques using heated hairstyling devices are used to style the hair near the ears and/or neck of the wearer. The ear cover 604 and the forehead cover are coupled together by the attachment features 780 and 832, respectively. As shown in FIGS. 8-9, in the illustrated variant, the attachment features 832 are elastic loops, which have stretched to accommodate the head of the wearer. The neck covers 612, 616 may overlie a portion of the neck and/or shoulders of the wearer. This may prevent heated hairstyling devices from contacting the skin of the wearer while hairstyling techniques using heated hairstyling devices are used to style the hair near the neck and/or shoulders of the wearer. The ear cover 604 and the neck covers 612, 616 are coupled together by the attachment features 784 and 928, respectively.

In some aspects, the wearer may wear the ear cover 604, the forehead cover 608, and the first and second neck covers 612, 616. In some aspects, the neck covers 612, 616 may be optional. In such aspects, the wearer may wear the ear cover 604 and the forehead cover 608. In some aspects, the forehead cover 604 may be optional. In such aspects, the wearer may wear the ear cover 604 and the first neck cover 612 and/or the second neck cover 616.

While a number of example aspects and aspects have been discussed above, those of skill in the art will recognize that still further modifications, permutations, additions and sub-combinations thereof of the features of the disclosed aspects are still possible. It is therefore intended that the following appended claims and claims hereafter introduced are interpreted to include all such modifications, permutations, additions and sub-combinations as are within their true spirit and scope.

What is claimed is:

1. A heat protection garment configured to protect skin of a wearer, the heat protection garment comprising:

an ear cover including a first lobe, a second lobe, and a connecting portion between the first lobe and the second lobe, the ear cover comprising:

a first surface configured to overlie the skin of the wearer;

a second surface opposite the first surface; and a panel coupled to the first surface of one of the first and second lobe to form a pocket between the panel and the first surface, wherein the ear cover has a first edge having a first curvature and an opposing second edge having a second curvature, the first curvature being greater than the second curvature, wherein the pocket is coupled to the first surface proximate the second edge, and wherein at least one attachment feature is coupled to the second surface proximate the second edge, the at least one attachment feature configured to engage a forehead cover.

2. A heat protection garment configured to protect skin of a wearer, the heat protection garment comprising:

an ear cover including a first lobe, a second lobe, and a connecting portion between the first lobe and the second lobe, the ear cover comprising:

a first surface configured to overlie the skin of the wearer;

a second surface opposite the first surface; and a panel coupled to the first surface of one of the first and second lobe to form a pocket between the panel and the first surface, wherein the ear cover has a first edge having a first curvature and an opposing second edge having a second curvature, the first curvature being greater than the second curvature, wherein the pocket is coupled to the first surface proximate the second edge, and wherein at least one attachment feature is coupled to the second surface proximate the first edge, the at least one attachment feature configured to engage a neck cover.

3. A heat protection garment configured to protect skin of a wearer, the heat protection garment comprising:

an ear cover including a first lobe, a second lobe, and a connecting portion between the first lobe and the second lobe, the ear cover comprising:

a first surface configured to overlie the skin of the wearer;

a second surface opposite the first surface; and a panel coupled to the first surface of one of the first and second lobe to form a pocket between the panel and the first surface wherein the ear cover has a first edge having a first curvature and an opposing second edge having a second curvature, the first curvature being greater than the second curvature, wherein the pocket is coupled to the first surface proximate the first edge, and wherein at least one attachment feature is coupled to the second surface proximate the first edge, the at least one attachment feature configured to engage a forehead cover.

4. A heat protection garment configured to protect skin of a wearer, the heat protection garment comprising:

an ear cover including a first lobe, a second lobe, and a connecting portion between the first lobe and the second lobe, the ear cover comprising:

a first surface configured to overlie the skin of the wearer;

a second surface opposite the first surface; and a panel coupled to the first surface of one of the first and second lobe to form a pocket between the panel and the first surface wherein the ear cover has a first edge having a first curvature and an opposing second edge having a second curvature, the first curvature being greater than the second curvature, wherein the pocket is coupled to the first surface proximate the first edge, and wherein at least one attachment feature is coupled to the second surface proximate the second edge, the attachment feature configured to engage a neck cover.

5. The heat protection garment of claim 4, wherein the ear cover includes an elastic element coupled between a side of the first lobe and a side of the second lobe.

6. The heat protection garment of claim 4, wherein the panel is a first panel and the pocket is a first pocket, and wherein a second panel is coupled to the first surface of the other of the first lobe and the second lobe and configured to form a second pocket between the second panel and the first surface.

7. The heat protection garment of claim 4, wherein the panel includes an elastic element proximate an opening of the pocket.

8. A heat protection garment configured to protect skin of a wearer, the heat protection garment comprising:

an ear cover including a first lobe, a second lobe, and a connecting portion between the first lobe and the second lobe, the ear cover comprising:

a first surface configured to overlie the skin of the wearer;

a second surface opposite the first surface; and a panel coupled to the first surface of one of the first and second lobe to form a pocket between the panel and the first surface, wherein at least one of the first lobe and the second lobe includes wiring positioned between the first and second surfaces along a perimeter of the at least one first and second lobe.

9. A heat protection garment configured to protect skin of a wearer, the heat protection garment comprising:

an ear cover including a first surface configured to overlie the skin of the wearer and a second surface opposite the first surface, the second surface including one or more first attachment features; and a forehead cover including a first surface configured to overlie the skin of the wearer and a second surface opposite the first surface, the forehead cover including one or more second attachment features configured to releasably engage the one or more first attachment features.

10. The heat protection garment of claim 9, wherein at least one of the one or more first attachment features and the one or more second attachment features include a stretchable element.

11. The heat protection garment of claim 9, wherein the forehead cover has an elongate shape and wherein the one or more second attachment features are positioned at opposing sides of the forehead cover.

12. The heat protection garment of claim 11, wherein an elastic element is coupled between the opposing sides of the forehead cover.

13. The heat protection garment of claim 9, where the ear cover includes a first lobe, a second lobe, and a connecting portion between the first lobe and the second lobe, and wherein the one or more first attachment features includes a first attachment feature positioned on each of the first lobe and the second lobe.

14. The heat protection garment of claim 9, wherein the second surface of the ear cover includes one or more third attachment features, and wherein the heat protection garment further comprises a neck cover including a first surface configured to overlie a wearer's skin and a second surface opposite the first surface, the neck cover including one or more fourth attachment features configured to releasably engage the one or more third attachment features.

15. A heat protection garment configured to protect skin of a wearer, the heat protection garment comprising:

an ear cover including a first surface configured to overlie the skin of the wearer and a second surface opposite the first surface, the second surface including one or more first attachment features; and a neck cover including a first surface configured to overlie the skin of the wearer and a second surface opposite the first surface, the neck cover including one or more second attachment features configured to releasably engage the one or more first attachment features.

16. The heat protection garment of claim 15, wherein the neck cover is a first neck cover, and further comprising a second neck cover, wherein a length of the first neck cover is greater than a length of the second neck cover.

17. The heat protection garment of claim 15, wherein the neck cover is a first neck cover, and further comprising a second neck cover, wherein a width of the second neck cover is greater than a width of the first neck cover.

* * * * *